US005487932A

United States Patent [19]

Dunshee

[11] Patent Number: 5,487,932

[45] Date of Patent: Jan. 30, 1996

[54] APPLICATOR WIPE FOR VISCOUS FLUIDS

[75] Inventor: Wayne K. Dunshee, Maplewood, Minn.

[73] Assignee: Minnesota Mining and Manufacturing Company, St. Paul, Minn.

[21] Appl. No.: 191,050

[22] Filed: Feb. 1, 1994

Related U.S. Application Data

[63] Continuation of Ser. No. 898,770, Jun. 12, 1992, abandoned.

[51] Int. Cl.[6] ..... A61B 17/20; B65D 75/00

[52] U.S. Cl. ..... 428/68; 15/104.93; 15/104.94; 206/209; 206/210; 206/361; 206/438; 206/441; 206/812; 428/74; 428/76; 428/343; 428/395

[58] Field of Search ..... 428/68, 74, 76, 428/343, 395; 206/209, 210, 361, 438, 441, 812; 15/104.93, 104.94

[56] References Cited

U.S. PATENT DOCUMENTS

| | | | |
|---|---|---|---|
| 2,621,784 | 12/1952 | Boytham | 206/46 |
| 3,057,467 | 10/1962 | Williams | 206/46 |
| 3,542,634 | 11/1970 | Such et al. | 161/88 |
| 4,397,754 | 8/1983 | Collishaw | 15/104.93 |
| 4,427,111 | 1/1984 | Laipply | 206/210 |
| 4,427,115 | 1/1984 | Laipply | 206/484 |
| 4,696,393 | 9/1987 | Laipply | 206/210 |
| 5,002,075 | 3/1991 | Kellett | 15/104.93 |
| 5,046,608 | 9/1991 | Laipply | 206/209 |

FOREIGN PATENT DOCUMENTS

| | | | |
|---|---|---|---|
| 491053 | 8/1938 | United Kingdom | 15/104.94 |

*Primary Examiner*—Nasser Ahmad

*Attorney, Agent, or Firm*—Gary L. Griswold; Walter N. Kirn; Dale A. Bjorkman

[57] ABSTRACT

A combined fluid storage container and applicator device for viscous fluids comprising a sheet-like impermeable material having overlying symmetrical or asymmetrical portions with a fold line and a temporary seal around the remaining periphery of the device forming a cavity for the fluid, a pad within the cavity and adhered to the sheet, and a separation mechanism for simultaneously applying continuous separating force in multiple directions to open the cavity and expose the pad. Methods of using the device are also disclosed.

13 Claims, 2 Drawing Sheets

APPLICATOR WIPE FOR VISCOUS FLUIDS

This is a continuation of application No. 07/898,770 filed Jun. 12, 1992, now abandoned.

FIELD OF THE INVENTION

The present invention relates generally to fluid applying devices and methods of manufacturing such devices. Specifically, the present invention relates to devices and methods of applying viscous fluids.

BACKGROUND

U.S. Pat. No. 2,621,784 discloses a package for containing an absorbent applicator pad for liquid medicaments and other materials. The package comprises a sheet of material folded to form a mitten for receiving the user's fingers and having a tab which is pulled or peeled in the plane of the package to open the same so that the pad can be removed.

An example of one type of absorbent material is disclosed in U.S. Pat. No. 3,542,634. Such material is used in the Webcol alcohol prep device sold by the Kendall Company, Boston, Mass., for example, for the purpose of applying sterilizing isopropyl alcohol to the skin of a patient. Another example of such absorbent material and a package for containing the same is disclosed in U.S. Pat. No. 3,057,467. The absorbent material is a folded towelette containing a particular fluid for cleansing and refreshing a user and the package material is, for example, an aluminum foil with a thermoplastic liner. Such package material is impervious to the fluid contained therein, including both the liquid and vapor or gas forms thereof. Such material also is impervious to air and other materials that might otherwise contaminate the fluid and absorbent material contained in the package. The '467 patent discloses polyethylene, polyvinyl resin or cellulose acetate as suitable thermoplastic materials for providing a protective coating on the foil and for providing the impervious vapor-proof barrier desired. Such materials also are readily heat sealable to seal closed the package. Other materials of which the package disclosed in the '467 patent may be made are cellulosic materials lined with a thermoplastic film or various synthetic or plastic materials. The device in the '467 patent is manufactured by forming a three part sandwich of two sheets of package material and the folded fluid impregnated towelette therebetween, and the edges of the package material sheets are heat sealed to each other about the entire perimeter of the package.

U.S. Pat Nos. 4,427,111, 4,427,115, 4,696,393, and 5,046,608 to Laipply disclose applicator wipes for inviscid fluids. The devices disclosed therein are integral fluid delivery devices comprising a one-piece fluid applying device formed of flexible material that is folded to form a chamber to contain a fluid. This chamber may optionally contain a fluid absorbent pad attached thereto to assist in delivery of the inviscid fluid.

SUMMARY OF THE INVENTION

The present invention provides a combined fluid storage container and applicator device for viscous fluids. The device comprises a sheet-like fluid impermeable material having opposed portions positioned in generally flat parallel overlying relation to each other. The opposed portions are sealed together by temporary fluid impermeable seal means to form a cavity that encloses fluid between the opposed portions. A low density fluid retaining pad is adhered to the material and disposed in the cavity such that the fluid is generally contained within the pad. Means for opening the temporary seal means along at least a part of the length of the seal line are provided to expose the fluid-containing pad.

Viscous fluids, as presently defined, are fluids having a viscosity of no less than 250 centipoise, preferably no less than 500 centipoise, and more preferably no less than 750 centipoise.

The low density fluid retaining pad, as presently defined, is a fiber pad or an open or partially open cell foam pad, wherein the pad has a density of no more than about 0.05 grams/cubic centimeter. Preferably, the pad has a density of between about 0.005 and 0.03 g/cm$^3$.

To express the viscous fluid from the pad using comfortable finger-pressure, the pad will preferably have a compression resistance of no more than 450 g/cm$^2$, and more preferably no more than 300 g/cm$^2$. Compression Resistance is defined as the amount of force required to compress a pad to substantially reduce the amount of free volume available to accommodate liquid contained therein. For purposes of the pads preferred in the present invention, this value may be determined by measuring the amount of force required to compress the pad to about one half of its non-compressed thickness. Alternatively, an evaluation of whether a pad has the desired compression resistance can be done by measuring the thickness of the pad when under pressure equalling 450 g/cm$^3$. If the pad under pressure is thinner than one half of its original thickness, it has a satisfactorily low Compression Resistance.

The combined fluid storage container and applicator device preferably has a pair of respective edges of the opposed portions securely joined with an edge seal along a fold line as an effectively single integral sheet of said opposed portions. This edge seal and fold line provide an effective handle for the person applying the viscous fluid, and assures that the respective portions will not be inadvertently separated by peeling apart of the temporary fluid impermeable seal means.

DETAILED DESCRIPTION OF THE PRESENTLY PREFERRED EMBODIMENTS

Figure 1:
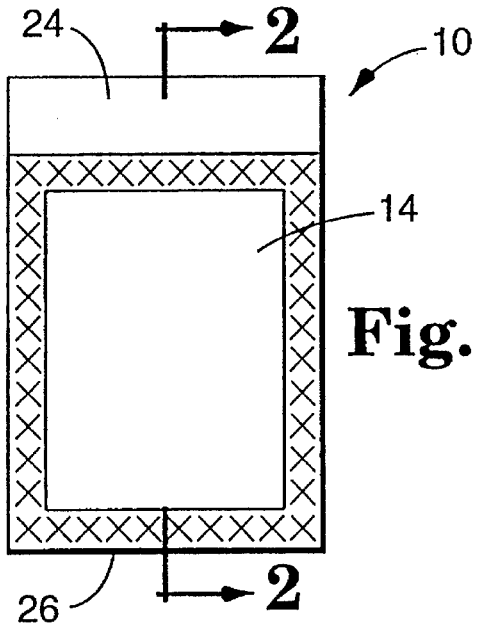
FIG. 1 is a plan view of an embodiment of the present invention.

The present invention advantageously allows for delivery of viscous liquids from a convenient dispensing system. The dispensing system also provides the benefit of having a built-in scrubbing surface in a pad.

Figure 2:
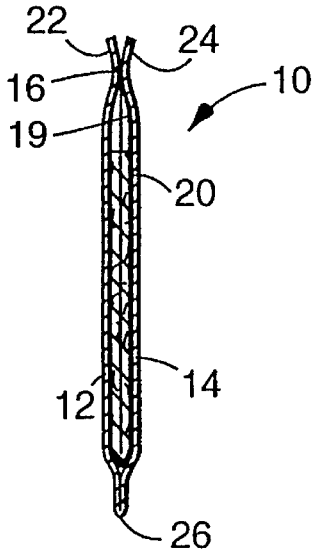
FIG. 2 is a cross-sectional view of embodiment as shown in FIG. 1, taken along line 2—2.

Referring now in detail to the drawing, wherein like reference numerals designate like parts in the several figures:

FIG. 1 is a plan view of package 10, and FIG. 2 is a cross-sectional view of the same embodiment taken along line 2—2. Package 10 has opposed portions 12 and 14, which opposed portions are fluid impermeable sheets. Opposed portions 12 and 14 are adhered one to another through temporary fluid impermeable seal means 16, which is located around the periphery of portions 12 and 14. Adhesion layer 19 is a separate layer of thermoplastic material that is provided between opposed portions 12 and 14 to provide a means of adhering portion 12 to portion 14, and to additionally provide a means to adhere pad 20 to portion 12 and/or portion 14. Temporary fluid impermeable seal means 16 is provided by applying heat sufficient to melt adhesion layer 19 at the periphery of portions 12 and 14, such that adhesion layer 19 forms a bond between portions 12 and 14. Alternatively, adhesion layer 19 may be a pressure-sensitive adhesive or the like, as discussed in more detail below. Low density fluid retaining pad 20 is fully disposed within the cavity formed by the joining of opposed portions 12 and 14 with seal means 16. Package 10 is provided with tails 22 and 24 which act as means for opening the package.

Figure 3:
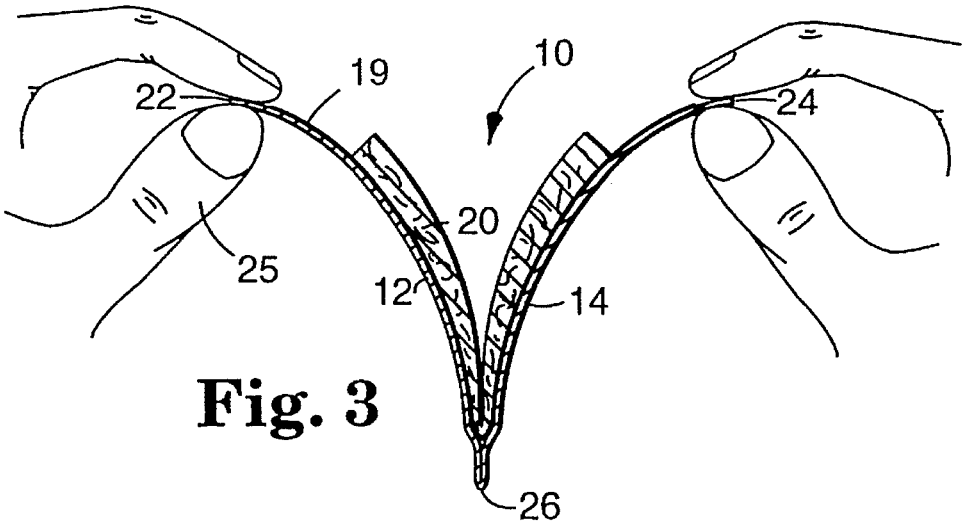
FIG. 3 is a cross-sectional view of an embodiment as shown in FIG. 1, as the container is being opened by the person using the container.

FIG. 3 shows a cross-sectional view of package 10 as it is being opened for dispensing of liquid. In use, user 25 grasps tails 22 and 24 and pulls in radially opposite directions to peel apart opposed portions 12 and 14, thereby exposing pad 20 for dispensing fluid contained therein.

Figure 4:
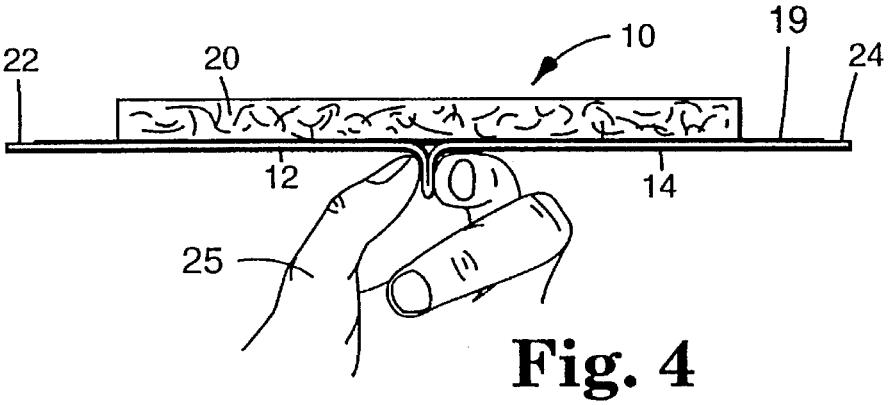
FIG. 4 is an end view of an embodiment, with the embodiment being in the open position.

FIG. 4 shows an end view of package 10 in a fully open state. When package 10 is in the open position, fold line 26 extends perpendicularly from the plane formed by opposed portions 12 and 14, acting as a handle for ready grasping by user 25 in applying fluid out of pad 20.

The fluid impermeable sheet from which portions 12 and 14 are formed preferably is a metal foil material, such as aluminum foil. This metal foil layer provides high moisture vapor transmission resistance. More preferably, the fluid impermeable sheet is a laminate of a metal foil layer and a thermoplastic liner layer, such as a polyethylene material, a polyvinyl resin, or a cellulose acetate. The thermoplastic liner layer provides protection for the metal foil from fluid contained within the package, and also provides structural integrity for the package itself. This thermoplastic liner layer may also perform the function of being a heat seal material for sealing portions 12 and 14 together, and for anchoring pad 20 to the portions 12 and 14. When the fluid impermeable sheet comprises such a thermoplastic layer, no separate adhesion layer 19 may be needed. The thermoplastic liner preferably may be selected from any appropriate material that may be laminated on the metal foil and having appropriate melt temperatures to exhibit heat sealing properties. Examples of such materials include polyethylene, ethylene vinyl acetate, ethylene vinyl acetate/polyethylene, polyether/polyethylene laminates (such as Scotchpak™ polyester film available from 3M), ionomeric resins (such as Surlyn™ film, available from Dow). Softer films, such as Parafilm™ film sold by American Can Company, may be used as an additional anchoring means for anchoring pad 20 to portions 12 and 14. Alternatively, the fluid impermeable sheet may comprise a foil together with a cellulosic material lined with a thermoplastic film or other synthetic or plastic materials. A paper layer added to the fluid impermeable sheet will provide an inexpensive printable surface and additional structural protection for the package as a whole.

The fluid impermeable sheet should be relatively strong in order to resist unwanted breakage and it should be impermeable to ordinary external contaminants, such as air, dust, bacteria, etc., and impermeable to the fluid contained in pad 20. Moreover, the fluid impermeable sheet should be unaffected by such fluid. The sheet should be relatively flexible to permit ordinary manipulation and flexing that may occur during packaging, storage and preparation for use, and preferably should be capable of being folded, for example, along fold line 26, while maintaining the mechanical integrity of the material so that the zone in which the fold occurs remains as a fluid tight boundary. The material also should be attachable to pad 20 in order to form an integral device that during ordinary use is not intended to encounter separation of pad 20 from portions 12 and 14. Further, the material should be capable of being sealed at seal 16 by thermal, mechanical or other means. The material should have adequate strength so that the force applied to tails 22 and 24 may be transmitted to seal 16 in order to provide a relatively facile selective controlled opening of the device 10 while breaching the integrity of seal 16 without damaging the integrity of other portions of the device 10.

The sheet should be a single or integral piece of material or should function as such. For example, portions 12 and 14 may be a single sheet. Alternatively and equivalently, portions 12 and 14 may be formed by two sheets securely joined, for example, at or at what will become the fold line 26 or area thereof. Such a joining or juncture of multiple sheets may be effected before folding at the fold line or may be effected during manufacturing of the device, e.g., whereby two such sheets are placed with overlying perimeter edges and one edge is securely bonded while the other(s) are sealed to form the breakable seal 16.

Seal 16 is a heat seal or pressure seal or a combination thereof. Specifically, it may be formed by applying heat while pressing portions 12 and 14 together in order to cause a bonding of adhesion layer 19 on portions 12 and 14. Pressure may be applied to assure good bonding characteristics in order to maintain a highly integral seal achieving substantially complete isolation of the chamber from the environment external to device 10. The seal may be formed in a variety of conventional manners. If desired, crimping, additional adhesive material, bonding material, or various liquid, semi-solid or solid materials may be applied to respond to temperature, pressure or other means for effecting a desired seal 16. Furthermore, seal 16 preferably is capable of being broken to breach the integrity thereof when a force is applied to tails 22 and 24 in order to separate portions 12 and 14, making the pad 20 accessible, to break generally uniformly during application of a balanced force thereto, and to avoid substantial tearing of portions 12 and 14. Optionally, any adhesive system may be used to anchor pad 20 to portions 12 and 14, or to form seal 16 including pressure-sensitive adhesives, solvent-releasing adhesives, hot-melt adhesives, contact adhesives, or the like.

Preferably seal 16 is formed between opposed portions 12 and 14, about the periphery or perimeter of the device 10. Fold 26 may form part of the periphery seal of the chamber. On the other hand, if portions 12 and 14 were totally separate pieces, the seal provided by fold 26 would be provided by means similar to those described above with respect to the remainder of the seal 16, for example, but would be so secure that the same would not break during ordinary use of the device 10.

Pad 20 may optionally be selected from a fiber pad or an open or partially open cell foam pad, wherein the pad has a density of no more than about 0.05 grams/cc. Preferably, the pad has a density range of between 0.005 to 0.01. When pad 20 is a fiber pad, the fibers may be selected from any appropriate fiber material including polyolefins (such as polypropylene and polyethylene), polyester, acetate, rayon, nylon, orlon, cotton, silk or hemp fibers. Fibers may alternatively be blends of the above materials, or may have sheath/core constructions. A preferred fiber is a dual polymer heat-bondable sheath core polyester, such as Celbond® available from Hoechst Celanese Corporation or the "Melty" fibers available from Unitika Ltd.

The fiber pad may be formed by any means that will result in a pad having the appropriate density, including webs formed by a needle tack process, melt blown, Rando® web air laying, hydroentanglement, binder fiber, resin binder or spun cast processes. Preferably, the web will exhibit good wet strength, so that the pad does not shed fibers during use. Also, liquid binders are not preferred in formation of the web because they may inhibit bonding of the pad to portions 12 and 14. Fibers may be selected in denier of up to about 15, with denier fibers of 1.5 to 3 being generally preferred, or blends of various denier fibers being preferred. Small denier fibers tend to anchor well to portions 12 and 14, while larger denier fibers tend to provide good loft, springiness and resilience to the pad. Blends of different denier fibers tend to provide excellent pads, because they can take advantage of the best aspects of both fiber sizes. Additionally, blends of different fiber types are contemplated. Preferred fibers of the present invention are sheath/core fibers. Pads made from these fibers tend to bond well to the substrate, have good integrity, and are nonabsorbing of the liquid to be dispensed.

When pad 20 is a foam, the foam must be in a open-cell or partially open-cell configuration, so that the liquid may be easily infused into and dispensed from the pad. When the foam has very small cell size, it tends to seal well to the substrate, much as small fiber pads seal well. Foams may be made from any appropriate material, including polyvinylchloride, polyurethane, cellulose acetate, polyolefins, epoxy resins, silicone resins, natural rubber, neoprene rubber, urea-formaldehyde resins, and the like, or blends thereof.

Alternatively, pad 20 may be a hybrid pad. That is, a foam pad may be needle tacked or otherwise processed to introduce fibers into or onto the foam pad. Such a pad could enjoy high strength and other benefits from the combination of these materials.

Other types of techniques may be used to attach pad 20 to the package material portions 12 and 14. For example, glue, tape, a direct heat seal, or a frame-like cover may be used for the purpose of holding pad 20 to the package material.

The pad may be attached to the package material either prior or subsequent to application of fluid to the pad. Preferably, the attachment is effected prior to delivery of the fluid to the pad. In particular, when a solvent or other curable adhesive, such as glue, is used to perform the attaching function, or when heat is necessary to effect attachment, it is desirable to permit solvents to evaporate or to permit the pad to cool before the fluid is applied to the pad. The strength of attachment of pad 20 to portions 12 and 14 should be adequate so that the two materials do not separate during ordinary usage of the device 10. The attachment of pad 20 to portions 12 and 14, then, should have suitable shear strength due to the usual rubbing action that the device 10 will undergo when applying fluid to a surface, whereas the tensile strength of the connection between the pad and package material is not quite as critical.

A device 10 in accordance with the present invention may be manufactured, for example, by the following steps. The fluid impervious sheet is cut to the desired shape. For example, the sheet may include foil already coated with a plastic liner. A fold or crimp may be applied if a handle is to be provided on the device. Adhesion layer 19 is placed into engagement with or applied to the package material, and then pad 20 is applied by placing the same into engagement with adhesion layer 19. Heat is applied to cause adhesion layer 19 to bond pad 20 to portions 12 and 14. Fluid is applied to pad 20, and the device then is folded, for example to the configuration shown in FIG. 1. The seal is formed by applying heat and/or force to the perimeter of the device defining the area of chamber while preferably not bonding the tails 22 and 24 together, which should remain separable for facile manual grasping and opening of the device 10.

An alternative method includes the step of bonding or otherwise securing, e.g., by crimping, heat sealing, adhesive, etc., two sheets to form a single integral sheet. Such bonding, etc. may be carried out before folding or it may be carried out in lieu of folding, specifically whereby the two sheets of material are placed in overlying position with pad 20 sandwiched therebetween, and the bond and seal 16 then may be formed.

An additional alternative method of making package 10 would be to fold portions 12 and 14 into a pocket first. Pad 20 is then inserted into the pocket thus formed and the entire assembly is heated to anchor the pad to portions 12 and 14. Pad 20 is then filled with fluid, either by gravity or injection with a pump, and the final seal is applied to close the package. In most cases, it is desirable to adhere pad 20 to portions 12 and 14 before infusing the pad with liquid, so that there is no interference with bonding of the various components of the package.

Another aspect of such methods of making a fluid application or wiping device, whether it be of integral type (one-piece) or not, relates to securement of pad 20 to the portions 12 and 14. Such method includes adhering, e.g., heat sealing, an absorbent pad to the essentially flat surface of a layer of an impermeable and adherable, e.g., heat sealable, material by affixing, e.g., heat sealing, a sufficient central area of the pad and/or sufficient peripheral areas, e.g., edges or corners, of the pad to secure and stabilize the pad in a defined location on the impermeable material preventing any significant movement of the pad relative to impermeable material during opening or use of the fluid storage and applications devices, with such process not involving formation of any recess or otherwise molded areas in impermeable material to help align and fix the pad and produce a more even (flush) surface for covering by a separate second layer or folded over layer of impermeable material. Preferably such method is carried out in an automated or continuous in-line process using essentially available equipment for manufacturing a fluid application device. According to an embodiment of the invention, the pad can be secured to the material at the region of the fold line, rather than on the flat surface of portions 12 and 14.

To use the device 10, the same may be held by a user and manipulated to open the device exposing pad 20. More specifically, the tails 22 and 24 may be grasped between the thumb and forefinger, for example, of both hands of the user and force tending to separate the tails may be applied. Such force should be adequate to break the seal 16 allowing the device 10 to be opened along the seal zone in response to a balanced force application thereto. When the device is fully open, whereupon the fold 26 or bonded area is straightened so that the device is substantially flat in the manner shown in FIG. 4, the user may grasp one of the tails 22 or 24 between thumb and forefinger while using the fingers of the same hand against the package material behind the area in which the pad 20 is located to provide a backing therefore; and the pad may be rubbed against a surface to apply fluid from the pad to the surface, e.g., for sterilizing, cleansing or like purposes. Importantly no part of the device 10 is intended to be torn away from another and discarded before or during use.

The present invention is particularly advantageous for delivering liquids that have high viscosity. For example, gels for cleaning and protecting leather, furniture polish, and the like, may be particularly advantageously delivered through an embodiment of the present invention. Also, metal cleaners and tarnish removers such as copper and silver Tarnishield™ cleaners, available from 3M, are also advantageously delivered in this manner. Personal care products, such as creams, sunscreens, and insect repellents that come in a cream or gel format would advantageously be delivered through this invention. Surprisingly, liquids having a viscosity as high as 1,000 centipoise, and even as high as 50,000 centipoise may be advantageously dispensed through the present invention.

Alternatively, the present invention may be effective to deliver wax lubricants or treatments. Such waxy materials may be loaded into the pad by heating to provide an effective flowability and allowed to solidify in the container. Such materials may be selected having viscosities up to and including a solid or semi-solid material that may be caused to flow under specific temperature or pressure conditions.

The delivery of highly pituitous materials (i.e., sticky and stringy materials having a high viscosity) presents difficult delivery problems in most systems. The present invention provides a clean and easy technique for delivery of such problem liquids.

The invention is further described by the following non-limiting examples.

Nonwoven pads prepared as described below were loaded with a gel (consisting of 0.75% carbomer, 0.75% triethanolamine, 10% propylene glycol, 0.1% quaternium 15, and 0.04% FD&C red dye #4) that was diluted with water to the appropriate viscosities. This loading was accomplished by cutting a 4 inch by 6 inch pad out of a larger pad and taping the leading edge of the 4×6 pad to the larger pad with Micropore™ surgical tape (commercially available from 3M) along the 4 inch dimension to provide a means for holding the pad when pulling through a hopper knife coater. The hopper knife was set at a thickness of about one-half the thickness of the pad to be coated, except where the high density of the pad prohibited traversal of the pad through the hopper knife assembly. An excess amount of the gel was placed in the hopper knife assembly, and the pad was pulled through the assembly. The pad was immediately weighed to determine the amount of gel infused into the pad. The amount of gel contained in the pad as a result of this loading technique is reported in Tables I and II below.

Nonwoven pads were formed using a Rando® web air laying process, and were heated to about 300° F. to form a solid bond with adjacent fibers. These pads were formed from the following fibers:

Examples 1–4, 7–9, 16, 17, 19, 20, 28, 30, 31, 32, 34, 35, 40, 43 and 44 comprise 50% 6 denier, 1½ inch Type 294 polyester fibers made by Hoechst Celanese Corporation and 50% 3 denier, 2 inch Type 255 bicomponent fiber which is a polyester core fiber having a copolyolefin sheath made by Hoechst Celanese Corporation.

Examples 5, 6, 10–15, 18, 21–27, 29, 33, 36–39, 41, 42, 45–47 comprise 50% 15 denier, 2 inch Type 431 polyester fibers made by Hoechst Celanese Corporation and 50% 4 denier, 2 inch Type K54 bicomponent fiber which is a polyester core fiber having a copolyester sheath made by Hoechst Celanese Corporation.

Comparative Examples A and B are thin pads provided by a melt-blown process, wherein the pad is additionally heat embossed. The pad is identified commercially described as a 100% polypropylene 2.5 ounces per square yard ERHT nonwoven wipe, available from Kimberly Clark Corporation. These pads are characteristic of pads used with inviscid fluids, as described in U.S. Pat. Nos. 4,427,111; 4,427,115; 4,696,393 and 5,046,608.

TABLE I

| 95,000 cps viscosity material 4 × 6 inch pads | | |
|---|---|---|
| Example No. | Grams add on wt. | Pad material density gm/cc |
| 1 | 53.65 | 0.0081 |
| 2 | 51.13 | 0.0090 |
| 3 | 20.41 | 0.0098 |
| 4 | 14.14 | 0.0134 |
| 5 | 21.1 | 0.0140 |
| 6 | 21.55 | 0.0140 |
| 7 | 17.21 | 0.0154 |
| 8 | 17.56 | 0.0157 |
| 9 | 17.95 | 0.0157 |
| 10 | 27.04 | 0.0160 |
| 11 | 25.04 | 0.0163 |
| 12 | 28.14 | 0.0177 |
| 13 | 25.79 | 0.0180 |
| 14 | 24.52 | 0.0185 |
| 15 | 25.79 | 0.0200 |
| 16 | 17.64 | 0.0209 |
| 17 | 20.96 | 0.0227 |
| 18 | 28.02 | 0.0235 |
| 19 | 19.27 | 0.0244 |
| 20 | 20.61 | 0.0267 |
| 21 | 22.37 | 0.0272 |
| 22 | 19.61 | 0.0287 |
| 23 | 20.71 | 0.0294 |
| 24 | 23.74 | 0.0300 |
| 25 | 22.62 | 0.0306 |
| 26 | 22.45 | 0.0324 |
| 27 | 23.72 | 0.0337 |
| 28 | 12.38 | 0.0458 |
| 29 | 17.64 | 0.0481 |
| 30 | 13.02 | 0.0490 |
| 31 | 9.35 | 0.0490 |
| 32 | 13.07 | 0.0499 |
| 33 | 12.81 | 0.0508 |
| 34 | 14.54 | 0.0535 |
| 35 | 9.22 | 0.0576 |
| 36 | 12.18 | 0.0577 |
| 37 | 11.74 | 0.0727 |
| 38 | 8.95 | 0.0785 |
| 39 | 4.86 | 0.1340 |

TABLE II

| 33,000 cps viscosity 4 × 6 inch pads | | |
|---|---|---|
| Example No. | Grams add on wt. | Pad material density gm/cc |
| 40 | 20.68 | 0.0096 |
| 41 | 32.49 | 0.0109 |
| 42 | 29.56 | 0.0129 |
| 43 | 20.3 | 0.0159 |
| 44 | 19.46 | 0.0159 |
| 45 | 18.76 | 0.0439 |

TABLE II-continued

| Example No. | 33,000 cps viscosity 4 × 6 inch pads Grams add on wt. | Pad material density gm/cc |
|---|---|---|
| 46 | 18.43 | 0.0455 |
| 47 | 18.15 | 0.0499 |
| Comparative Example A | 3.27 | 0.1122 |
| Comparative Example B | 3.48 | 0.1129 |

Figure 5:
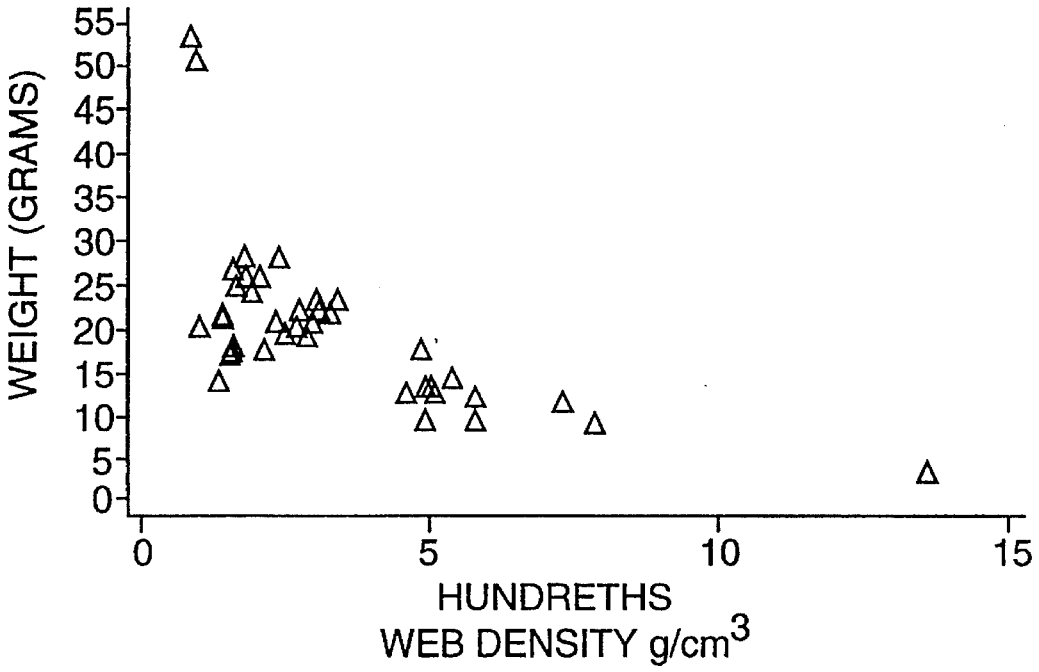
FIG. 5 is a graphic representation of amount of 95,000 cp viscosity liquid that can be infused into webs having various web densities using a hopper knife coating technique.
Figure 6:
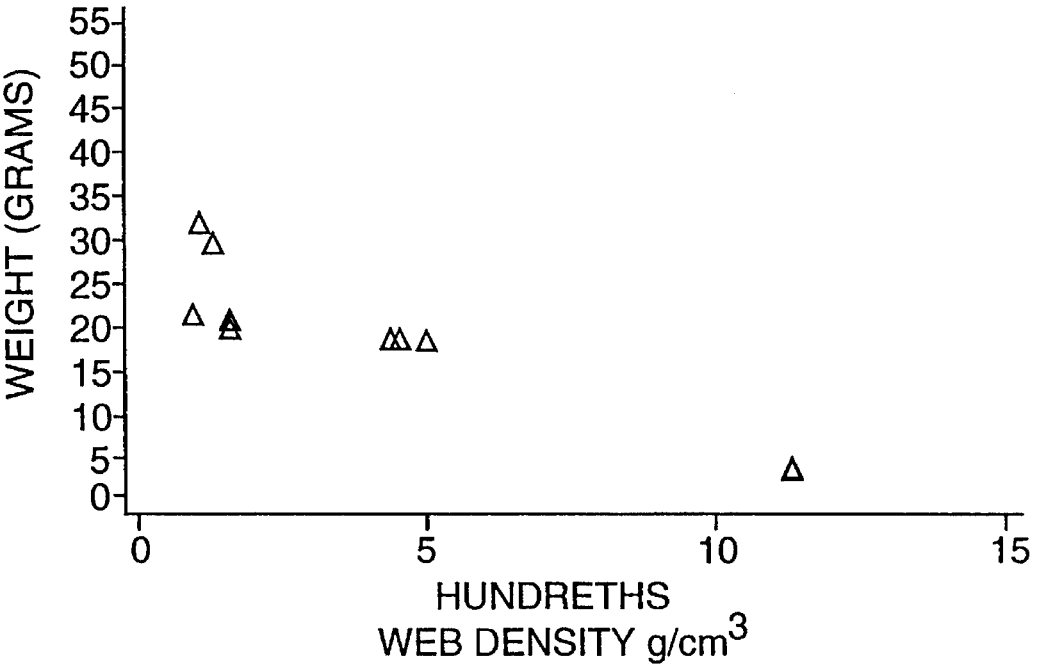
FIG. 6 is a graphic representation of amount of 33,000 cp viscosity liquid that can be infused into webs having various web densities using a hopper knife coating technique.

Information provided in Tables I and II are graphically represented in FIG. 5 and FIG. 6, respectively. As may be seen in these figures, packages made in accordance with the present invention accommodate much larger amounts of viscous fluids. Such packages will provide superior delivery of larger amounts of viscous fluids than previously possible in a convenient, small dose system.

The invention has been described in detail with particular emphasis on the preferred embodiments, but it should be understood that variations and modifications within the spirit and scope of the invention may occur to those skilled in the art to which the invention pertains.

We claim:

1. A combined fluid storage container and applicator device for viscous fluids, said device comprising a fluid impermeable sheet material having opposed portions positioned in generally flat parallel overlying relation to each other, temporary fluid impermeable seal means sealing said opposed portions to each other along a temporary seal line forming a cavity and enclosing a viscous liquid having a viscosity no less than 250 centipoise between said opposed portions, a low density fluid retaining pad having a density of no more than 0.05 g/cm$^3$ and a compression resistance of no more than 450 g/cm$^2$ adhered to each of said opposed portions of said material and disposed in said cavity such that said viscous liquid is generally contained within said pad, and means for opening said temporary seal means along at least a part of the length of said seal line to expose the viscous liquid containing pad that may assume a generally flat configuration while said pad is adhered to each of said opposed portions of said material.

2. The fluid storage container of claim 1, wherein said low density fluid retaining pad is a fiber pad.

3. The fluid storage container of claim 1, whereas said low density fluid retaining pad is a nonwoven web fiber pad.

4. The fluid storage container of claim 1, wherein said low density fluid retaining pad is an open cell foam pad.

5. The fluid storage container of claim 1, wherein said low density fluid retaining pad is a partially open cell foam pad.

6. The fluid storage container of claim 2, wherein the fibers of said pad are selected from the group consisting of polyolefin, polyester, acetate, rayon, nylon, orlon, cotton, silk and hemp fibers, and blends thereof.

7. The fluid storage container of claim 6, wherein the fibers of said pad are selected from the group consisting of polypropylene and polyethylene fibers.

8. The fluid storage container of claim 2, wherein the fibers of said pad are dual polymer heat-bondable sheath core polyester fibers.

9. The fluid storage container of claim 4, wherein said foam pad is made from a material selected from the group consisting of polyvinylchloride, polyurethane, cellulose acetate, polyolefins, epoxy resins, silicone resins, natural rubber, neoprene rubber, and urea-formaldehyde resins.

10. The fluid storage container of claim 1, wherein said low density fluid retaining pad has a density of between about 0.005 and 0.01 g/cm$^3$.

11. The fluid storage container of claim 1, wherein said viscous liquid has a viscosity of no less than 500 centipoise.

12. The fluid storage container of claim 1, wherein said viscous liquid has a viscosity of no less than 750 centipoise.

13. The device of claim 3, wherein said fluid is selected from personal care creams and gels.

* * * * *